US006145233A

United States Patent [19]

Hickmott

[11] Patent Number: 6,145,233

[45] Date of Patent: Nov. 14, 2000

[54] PLANT TAG

[75] Inventor: Robert C. Hickmott, Lansing, Mich.

[73] Assignee: The John Henry Company, Lansing, Mich.

[21] Appl. No.: 09/217,271

[22] Filed: Dec. 21, 1998

[51] Int. Cl.[7] ..... G09F 3/10; G09F 23/00

[52] U.S. Cl. ..... 40/673; 40/645

[58] Field of Search ..... 40/299.01, 310, 40/315, 322, 331, 637, 645, 664, 673; D20/22, 27, 28

[56] References Cited

U.S. PATENT DOCUMENTS

| | | | |
|---|---|---|---|
| D. 289,131 | 4/1987 | Stehouwer . | |
| D. 306,043 | 2/1990 | Hickmott . | |
| 1,272,394 | 7/1918 | Devney | 40/331 |
| 1,276,735 | 8/1918 | Devney | 40/331 |
| 2,847,774 | 8/1958 | Brooks . | |
| 3,196,567 | 7/1965 | Boehmer et al. | 40/310 |
| 3,290,808 | 12/1966 | Delitz | 40/673 X |
| 3,775,882 | 12/1973 | Wheeler . | |
| 3,822,441 | 7/1974 | Paxton . | |
| 4,197,984 | 4/1980 | Hartman et al. | 40/310 X |
| 4,379,372 | 4/1983 | Alexander et al. . | |
| 4,407,082 | 10/1983 | Stehouwer . | |
| 5,348,156 | 9/1994 | Maroszek et al. | 40/310 X |
| 5,390,435 | 2/1995 | Grody | 40/658 X |
| 5,423,139 | 6/1995 | Feldman | 40/673 |
| 5,826,356 | 10/1998 | Lapp | 40/299.01 X |

FOREIGN PATENT DOCUMENTS

| | | | |
|---|---|---|---|
| 2067507 | 7/1981 | United Kingdom | 40/310 |

*Primary Examiner*—Brian K. Green
*Attorney, Agent, or Firm*—Price, Heneveld, Cooper, DeWitt & Litton

[57] ABSTRACT

A tag has a body and an integral attachment end having a die cut pattern of slots defining mating inwardly projecting tangs of differing lengths to provide an adjustable diameter aperture upon deflection of the tangs. The tangs provide secure gripping of the tag to objects preventing inadvertent removal but allowing manual removal when desired.

16 Claims, 2 Drawing Sheets

PLANT TAG

BACKGROUND OF THE INVENTION

The present invention relates to a tag and more particularly a plant tag with an improved attachment structure.

Existing tags and particularly tags used in connection with live plants and nursery stock in an outdoor environment are subject to ripping and tearing under windy conditions or inadvertent falling off when plants are being moved either during the purchasing or as nursery stock is being moved from one place to another. The problem is particularly severe where the tag body is relatively large to accommodate printed material such as photographs of the plant, planting instructions, care instructions, and the like.

A wide variety of plant tags have been proposed which address these problems. One is disclosed in U.S. Pat. No. 4,407,082, which utilizes a wire reinforced tie attached to the tag body which tie can be wrapped around a plant stalk and around itself for attachment of the tag to the nursery stock. Although such a tag solves the problems of inadvertent removal, such tags are somewhat expensive to manufacture inasmuch as they involve the process of attaching a wire-reinforced tie to a polymeric tag body as well as cutting and forming the tag body and tie separately.

Tags have also been employed with slotted apertures which allow the tag to be inserted laterally onto a branch, such as disclosed in U.S. Pat. Nos. Des 289,131 and Des 306,043. U.S. Pat. No. 3,775,882 discloses an attachment arm integrally formed with a tag body and having an end which interlocks in a slot in the tag body. Other plant tags have employed a keyhole-shaped slot which allows the insertion of the hook of a plant pot hanger through the enlarged portion of the slot and subsequently shifted to the narrower portion of the keyhole slot for attachment. Although such tag designs reduce the cost of the tag, the attachment can be somewhat difficult or the tags may be either too easily removed or very difficult to remove. Also, it is desirable to provide a tag having an attachment structure which accommodates different sized articles.

SUMMARY OF THE INVENTION

There exists, therefore, a need for a tag which can withstand the rigors of the outdoor environmental use for nursery stock as well as use generally for live plants and the like regardless of the environment and which is relatively inexpensive to manufacture, easy to attach to plant hangers, nursery stock or live plants and which, while remaining firmly attached, can also be relatively easily removed when desired.

It has been discovered that by providing a tag with an attachment end having a die cut pattern of congruent and adjacent slots defining mating inwardly projecting triangular tangs of differing lengths, an adjustable aperture is defined upon deflection of the tangs, which allows the tag to be relatively easily installed. The tangs provide secure gripping of the tag to the article preventing inadvertent removal while allowing manual removal when desired. Such a tag can be manufactured by printing a plurality of such tags on sheet stock and subsequently and simultaneously die cutting the outline of each tag and the mounting aperture, thereby providing a relatively inexpensive tag with improved performance. These and other features, objects and advantages of the present invention will become apparent upon reading the following description thereof together with reference to the accompanying drawings.

DETAILED DESCRIPTION OF THE PREFERRED EMBODIMENT

Figure 1:
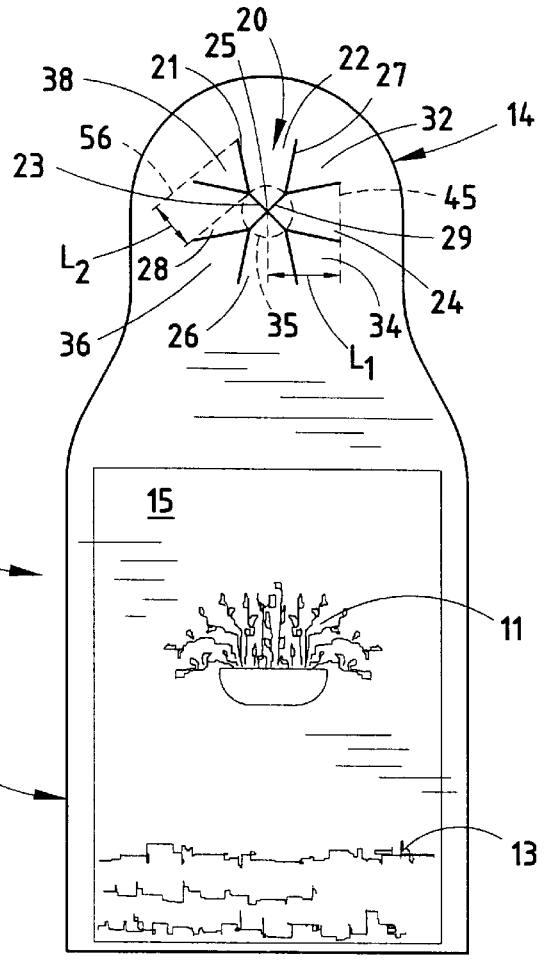
FIG. 1 is a front elevational view of a tag embodying the present invention.

Referring initially to FIG. 1, there is shown a tag 10 embodying the present invention and which includes an integral body 12 and an attachment end comprising a mounting tab 14. Printed on the tag body 12, which can be relatively large to accommodate such printing, is a photographic representation of a tree or plant 11 and printed indicia 13, such as planting directions, care directions, lighting requirements, soil requirements and the like. The tag body 12 may be printed on both the front side 15 or the reverse side with such information. In the embodiment shown, for example, the tag body 12 had a width of approximately 2" and a height of approximately 2¾", with the curvilinear mounting tab extending upwardly approximately 1½". The tag is integrally formed of sheet stock of any suitable polymeric material, such as a polyolefin, and in the preferred embodiment commercially available STACON material was employed. The thickness of the polymeric material was approximately 0.010" to 0.015", although different thicknesses can be employed. Centered within mounting tab 14 extending integrally from the body 12 of tag 10 is a mounting structure 20 comprising an array of die cut slots defining four generally pentagon shaped tangs 22, 24, 26 and 28. Each of the tangs face inwardly and terminate in a central apex 25. Interspersed in alternately staggered relationship with the mounting tangs 22, 24, 26 and 28 are triangular mounting tangs 32, 34, 36 and 38. Each of these tangs also have a tip 55 as described below falling on the diameter of a circle 35 shown in phantom form in FIG. 1 for purposes of describing the geometry of the mounting structure 20.

Figure 2:
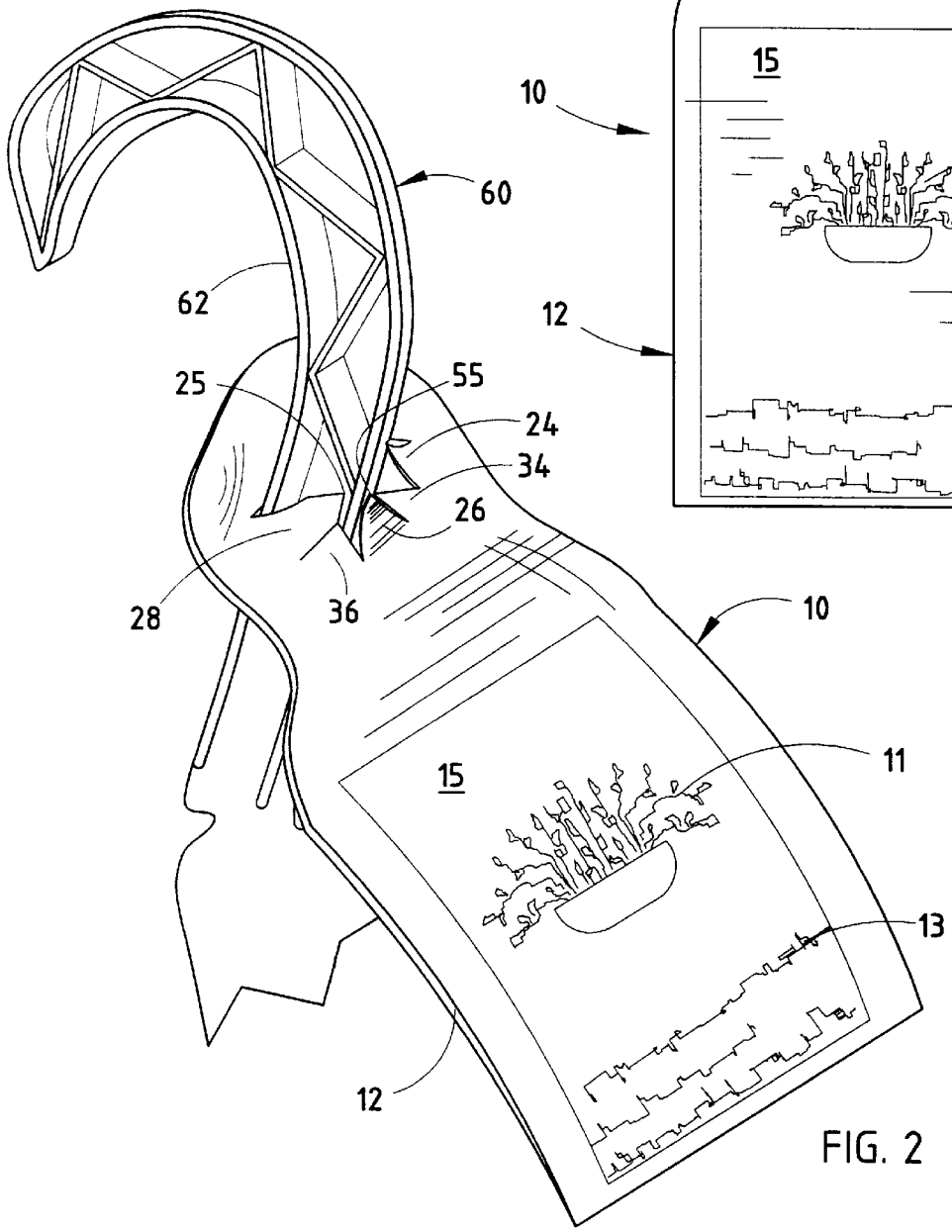
FIG. 2 is an enlarged perspective view of the tag shown in FIG. 1, shown attached to a hanger for a pot.
Figure 3:
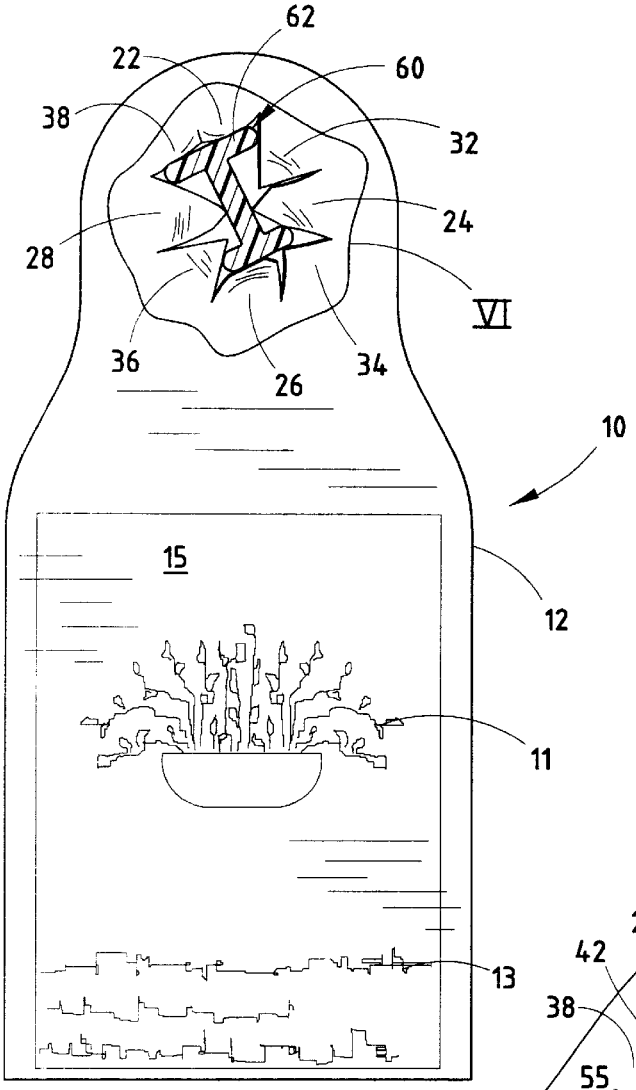
FIG. 3 is a front elevational view of the tag shown in FIG. 2, showing the hanger in cross section.
Figure 4:
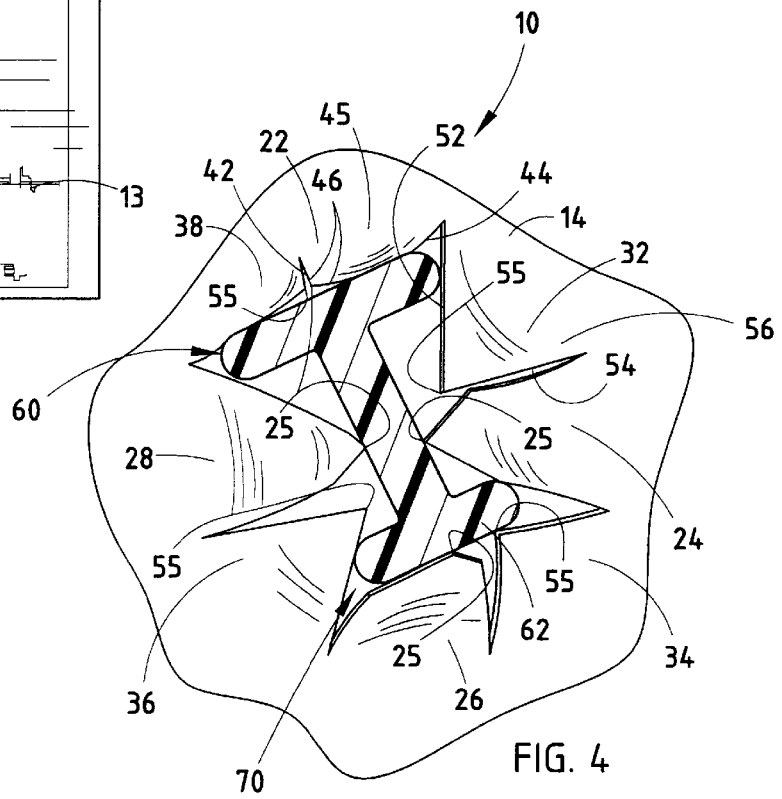
FIG. 4 is a greatly enlarged view of the circled area IV in FIG. 3.

Each of the tangs are formed by die cuts extending through the material of the tab 14 with tang 22, for example, and adjacent tangs 32 and 38 defined in part by a first die cut slot 21, a second die cut slot 23, a third die cut slot 27 and a fourth die cut slot 29. Slots 21 and 27 define the inwardly converging edges of the sides of tang 22 while die cut slots 23 and 29 converge at the tip or apex 25 of each of the tangs 22, 24, 26 and 28. Thus, the somewhat pentagonal shaped tangs 22, 24, 26 and 28 are defined by slightly inwardly converging edges or sides 42, 44 (FIG. 4) extending from the deflectable fold line 45, as seen in FIGS. 2–4. Line 45 forms the fifth side of the five-sided tangs. The apex 25 of each of the tangs 22, 24, 26 and 28 are defined by the inwardly tapered and joined edges 46 forming the triangular end of the tangs.

The alternately staggered triangular tangs 32, 34, 36 and 38 are defined by the same die cut slots 21, 23, 27 and 29 defining the generally pentagonal tangs. Each of the triangular tangs include a first edge 52 (FIGS. 3–5), a second edge 54 with the edges 52 and 54 converging inwardly to a tip 55 which lies on the diameter of imaginary circle 35, as seen in FIG. 1, and which, therefore, defines a circular opening upon deflection of the pentagonal tangs 22, 24, 26 and 28, as best seen in FIG. 4. The triangular tangs 32, 34, 36 and 38 can also deflect along a bend line 56 (FIG. 4) to accommodate different sized hooks 60 or stems or stalks of a live plant, nursery stock, tree or other object to which the tag 10 is attached.

The geometry of the die cuts 21, 23, 27 and 29 and corresponding slots defining each of the tangs are, in the preferred embodiment, cut such that four generally pentagonal tangs 22, 24, 26 and 28 are formed at 90° spaced intervals interspersed with alternately staggered triangular tangs 32, 34, 36 and 38 also spaced at 90° with respect to one another and also in opposed facing relationship with another one of the triangular tangs. Thus, the mounting structure 20 of the preferred embodiment defines a plurality of congruent tangs with different lengths all formed from a die cut pattern and which tangs define gripping tips which engage the edge 62 of an object, such as a hook 60 of a pot hanger, for securely holding the tag thereon. Tangs 22, 24, 26 and 28 have a length $L_1$ (FIG. 1) along their longitudinal axis of about ⅜"while triangular tangs 32, 34, 36 and 38 forming equilateral triangles had a height $L_2$ (FIG. 1) of about ¼".

As can be appreciated, the elongated, generally pentagonal tangs 22, 24, 26 and 28 are somewhat more flexible than the shorter triangular tangs 32, 34, 36 and 38 and, therefore, allow relatively easy insertion of the tag over an object, such as hook 60, since they relatively easily deflect. Also, the different length tangs accommodate uneven and irregularly shaped objects such as the I-shaped cross section 62 (FIG. 4) of hook 60. Once inserted, however, the surfaces of the generally pentagonal tangs engage the edges 62 of the object while the apices 25 of the triangular tangs 32, 34, 36 and 38 tend to grip the edge surfaces 62 with either a greater compressive force or with the tip 55 engaging and thereby locking the tag in place. If the diameter of the object 60 is greater than the diameter of the phantom circle 35, having in the preferred embodiment of the invention a diameter of about ⅝", the triangular tangs will also deflect as necessary to accommodate object 60 in a relatively large range of diameters. Thus, relatively small objects will only deflect the generally pentagonal tangs 22, 24, 26 and 28 either slightly or a greater amount as necessary until the diameter increases to the apices of the triangular tangs 32, 34, 36 and 38, at which time the tag will accommodate larger diameter objects up to, for example, ⅞" in one embodiment. In the preferred embodiment, the adjustable aperture 70 (FIG. 4) defined by the tangs is completely surrounded by the material forming the mounting tab 14 (i.e., there are no radial slits which could weaken the holding ability of the tag).

Thus, with the construction of the holding structure of the tag of the present invention, a variable or adjustable diameter aperture is defined by a plurality of alternately staggered tangs of different lengths and stiffnesses to accommodate a wide range of objects to which the tag may be attached and which securely holds the tag to the object when so attached. This construction, which is relatively inexpensive due to the integral manufacture and die cutting of the tag shape and generally star-shaped, outwardly radiating cuts defining the plurality of tangs, while the flexibility of the tag in accommodating a variety of sizes of objects as well as providing improved holding ability is greatly improved.

It will become apparent to those skilled in the art that various modifications to the preferred embodiment of the invention as described herein can be made. Such variations may, for example, include increasing the numbers of die cuts to increase the number of tangs or alternatively reducing the number of die cuts to reduce the number of tangs. It is important, however, that the mounting structure 20 include generally opposed tangs defining resilient arms which grip an object once inserted thereover and accommodate different sized objects.

These and other modifications to the preferred embodiment of the invention as described herein can be made by those skilled in the art without departing from the spirit or scope of the present invention as defined by the appended claims.

The invention claimed is:

1. A tag for attachment to a hanger of a hanging plant which facilitates attachment and resists removal, said tag comprising:

a tag body; and a mounting tab integrally formed with said body, said tab including a plurality of slots formed therein to define a plurality of radially inwardly facing tangs of different lengths for selectively and successively gripping a hanger extended through said mounting tab by successively deflecting said tangs as said tab is placed over the hanger;

wherein said tangs include a plurality of first tangs having a first length and a plurality of alternately staggered second tangs having a second length different than the first length; and wherein said first tangs are generally pentagonal in shape and have a length greater than the length of said second tangs.

2. The tag as defined in claim 1 wherein said second tangs are generally triangular.

3. The tag as defined in claim 2 wherein said generally pentagonal tangs are defined by a first pair of inwardly converging edges and a second pair of inwardly converging edges extending from said first edges and terminating in a pointed tip.

4. The tag as defined in claim 3 wherein said tip of each of said first tangs meet at a point in said mounting tab.

5. The tag as defined in claim 4 wherein said generally triangular tangs are defined by a pair of inwardly projecting edges terminating in a tip and wherein the tips of said triangular tangs are aligned in a pattern to define a circle concentric with said point in said mounting tab.

6. The tag as defined in claim 5 wherein said tag body is made of a polymeric material.

7. The tag as defined in claim 6 wherein said polymeric material has a thickness of from about 0.010" to about 0.015".

8. The tag as defined in claim 7 wherein said tag body has printed indicia thereon.

9. The tag as defined in claim 8 wherein said first tangs have a length of about ⅜".

10. The tag as defined in claim 9 wherein the triangular tangs have a length of about ¼".

11. A nursery tag for use with live plants comprising:

a tag body including a plurality of slots formed therein to define alternately staggered radially inwardly facing tangs of different shapes and lengths for successively gripping one of a plant stake and plant hanger which is extended through the tag by deflecting said tangs, wherein said tangs include four first tangs spaced at 90° intervals and four alternately staggered second tangs spaced at 90° intervals;

wherein said first tangs have a length of about ⅜" and said second tangs have a length of about ¼"; and wherein said first tangs are generally pentagonal and are defined by a first pair of inwardly converging edges and a second pair of inwardly converging edges extending from said first edges and terminating in a pointed tip.

12. The tag as defined in claim 11 wherein said tip of each of said first tangs meet at a point.

13. The tag as defined in claim 12 wherein said second tangs are generally triangular projection which are defined by a pair of inwardly projection edges terminating in a tip and wherein the tip of said second tangs are aligned in a pattern to define a circle which is concentric with said point of said first tangs.

14. The tag as defined in claim 13 wherein said tag body is made of a polymeric material.

15. The tag as defined in claim 14 wherein said polymeric material has a thickness of from about 0.010" to about 0.015".

16. The tag as defined in claim 15 wherein said tag body has printed indicia thereon.

* * * * *

UNITED STATES PATENT AND TRADEMARK OFFICE

CERTIFICATE OF CORRECTION

PATENT NO. : 6,145,233
DATED : November 14, 2000
INVENTOR(S) : Robert C. Hickmott It is certified that error appears in the above-identified patent and that said Letters Patent is hereby corrected as shown below:

Column 5, claim 13,
Lines 2, 3, "projection" should be -- projections --.
Line 4, "tip" should be -- tips --.

Signed and Sealed this

Thirtieth Day of October, 2001

*Attest:*

Nicholas P. Godici

NICHOLAS P. GODICI
*Acting Director of the United States Patent and Trademark Office*

*Attesting Officer*

UNITED STATES PATENT AND TRADEMARK OFFICE

CERTIFICATE OF CORRECTION

PATENT NO. : 6,145,233
DATED : November 14, 2000
INVENTOR(S) : Robert C. Hickmott It is certified that error appears in the above-identified patent and that said Letters Patent is hereby corrected as shown below:

Column 5, claim 13,
Line 3, "projection" should be -- projecting --.

Signed and Sealed this

First Day of January, 2002

*Attest:*

*Attesting Officer*

JAMES E. ROGAN
*Director of the United States Patent and Trademark Office*